US006171361B1

(12) United States Patent
Fu et al.

(10) Patent No.: US 6,171,361 B1
(45) **Date of Patent: *Jan. 9, 2001**

(54) HIGH FLUORINE FRITS FOR CONTINUOUS CASTING OF METALS

(75) Inventors: Dechun Fu, Columbia, MD (US); Manfred Beck, Lewiston, NY (US)

(73) Assignee: PEMCO Corporation, Baltimore, MD (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/644,674

(22) Filed: May 7, 1996

(51) Int. Cl.[7] ..... C22B 7/00
(52) U.S. Cl. ..... 75/305; 75/303; 75/300
(58) Field of Search ..... 75/305, 303, 300

(56) References Cited

U.S. PATENT DOCUMENTS

| | | | |
|---|---|---|---|
| 3,649,249 | 3/1972 | Halley et al. | 75/96 |
| 3,704,744 | 12/1972 | Halley et al. | 164/82 |
| 3,899,324 | 8/1975 | Corbett | 75/94 |
| 3,926,246 | 12/1975 | Corbett et al. | 164/56 |
| 4,190,444 * | 2/1980 | Carini | 75/257 |
| 4,235,632 * | 11/1980 | Uher et al. | 75/257 |
| 4,290,809 | 9/1981 | Loane, Jr. | 75/257 |
| 4,303,120 * | 12/1981 | Carini | 164/472 |

* cited by examiner

*Primary Examiner*—Patrick Ryan
*Assistant Examiner*—M. Alexandra Elve
(74) *Attorney, Agent, or Firm*—Venable; Ashley J. Wells

(57) ABSTRACT

A glass composition which is lithium-free and which is suitable as a metallurgical mold powder includes, based on total weight of the glass composition:

| Oxide | wt % |
|---|---|
| $Na_2O$ | 0.2–14.4 |
| $K_2O$ | 0.0–2.5 |
| CaO | 31.0–41.9 |
| $Al_2O_3$ | 4.9–8.5 |
| $B_2O_3$ | 0.00–1.9 |
| $SiO_2$ | 15.6–30.0 |
| F | 18.1–30.8 |

wherein the glass composition has a total content of $Na_2O+K_2O+CaO$ which ranges from about 38.4 to about 52.6% so that the glass composition is lithium-free and suitable as a metallurgical mold powder.

2 Claims, No Drawings

HIGH FLUORINE FRITS FOR CONTINUOUS CASTING OF METALS

FIELD OF THE INVENTION

The present invention relates to a lithium-free, opaque glass composition suitable for use as a mold powder in continuous casting applications; more particularly, the glass composition is characterized in its high fluorine content.

BACKGROUND OF THE INVENTION

Synthetic slag, sometimes referred to as "flux" or "mold powder", has been used in the continuous casting of metals including aluminum- or silicon-killed steels, austenite stainless steels, etc., for several purposes. Firstly slag is used to protect the molten metal from air oxidation. Constituents of the melt, such as iron, aluminum, manganese, chromium, titanium and the like are converted to oxides when exposed to air. These oxides are a source of non-metallic inclusions in the solidified metal the presence of which is decidedly undesirable. At the same time, the loss of these constituents through oxidative processes changes the compositional makeup of the resultant alloy. Secondly, the mold powders are used as fluxes to solubilize and remove oxide impurities present in the melt, therefore allowing for the production of clean, inclusion-free steel. The mold powders are further used to improve the lubrication between the mold and the solidifying strand of steel as it is continuously withdrawn.

In the trade the terms "flux" and "slag" often have been used interchangeably to describe fritted, or preponderantly fritted, mold powders which are used in the continuous casting industry. In the present context, "flux" is defined as a fluorine-bearing frit or compound that can be used to lower the viscosity of molten slag compositions at high temperatures.

During continuous casting of steel, increasing amounts of oxide impurities present in the molten steel are absorbed into the molten slagging composition. With increasing service time, the performance of the slagging composition deteriorates to such a degree that the steel output of the caster must be slowed down because the molten composition cannot transfer heat away from the forming solid steel shell fast enough to thicken the shell sufficiently. Also, the surface of the steel being cast shows more and more inclusions because the molten slagging composition cannot absorb impurities. At the same time, with the increasing presence of oxide impurities in the slagging composition, its viscosity may increase to such a high value that its necessary function as a lubricant for the mold is no longer provided. The rise in the viscosity of the liquid slagging composition may hinder its movement into the gap between the mold wall and the forming solid steel shell. In such instances where the gap is not lubricated due to the absence of liquid slag, the steel shell may seize on the wall of the mold and the likelihood of breakout can not be discounted. When one or more of these occurs, corrective actions must be taken and the caster run must be interrupted or shut down completely.

In the art of glass making, it has long been known that the incorporation of fluorine effectively reduces the viscosity of glass compositions at high temperatures. It could not however been projected that the incorporation of fluorine in the glass composition would be beneficial in the context of flux in continuous casting applications.

The atmosphere in the upper segment of a steel caster is usually one of high temperature and moisture. Fluorine released from the mold powder may cause metallic corrosion in the upper segment of the caster as a result of acid formation. Additionally, for most continuous casting processes it is important that little or no water be introduced with the flux. The presence of even small amounts of absorbed moisture (e.g. 5+% relative to the weight of flux) in the context of casting of steel may cause excessive oxidation. Accordingly, the dryness of the flux is preferably maintained and more preferably, the flux is made to contain no hygroscopic components.

Relevant synthetic slag compositions for continuous casting of steel have been disclosed in U.S. Pat. No. 3,649,249. The composition thus disclosed is said to have a high solubility of aluminum oxide. The slags thus disclosed containing high amounts of fluorine and at least some lithium, an element the absence of which characterizes the present invention. Also relevant to the background of the present invention are U.S. Pat. No. 3,704,744 which disclosed synthetic slag composition containing fluorine and lithium having a high solubility for aluminum oxide, and U.S. Pat. Nos. 3,899,324 and 3,926,246 which disclosed flux compositions which contain as much as 15% fluorine. Lastly, U.S. Pat. No. 4,290,809 disclosed a raw mix flux for the continuous casting of steel. The chemical analysis of the mixture show the raw batch to contain as much as 25% fluorine.

It is an objective of the present invention to provide a vitrified glass containing a large amount of fluorine. It is another objective of the present invention to provide a vitrified glass suitable for blending with other components to prepare mold powders for applications in continuous casting of steels and other metals.

It is another objective of the present invention to provide a process for the production of high fluorine frit and fritted particulates.

SUMMARY OF THE INVENTION

A lithium-free, opaque glass composition having a high fluorine content, suitable as a metallurgical mold powder is disclosed. The inventive glass composition is described below in terms of its oxide constituents, the amounts shown are in weight percent:

| Oxide | Weight percent |
|---|---|
| $Na_2O$ | 0.2–14.4 |
| $K_2O$ | 0.0–2.5 |
| CaO | 31.0–41.9 |
| $Al_2O_3$ | 4.9–8.5 |
| $B_2O_3$ | 0.0–2.0 |
| $SiO_2$ | 15.6–30.7 |
| F | 14.4–30.8 |

The composition, found to be suitable as a source of fluorine in mold powders, is further characterized in that the total content of $Na_2O+K_2O+CaO$ is 38.4 to 52.6%.

DETAILED DESCRIPTION OF THE INVENTION

The glass frit of the instant invention is made conventionally in a smelter or the like. Molten glass from the smelter is conventionally fritted by pouring it as a stream into water or by passing between chilled steel rolls. Often the resulting frit is milled (ground) to pass 150 mesh (Tyler Standard) or finer for use in continuous casting.

| Oxide | wt % |
|---|---|
| $Na_2O$ | 0.0–20.0 |
| $K_2O$ | 0.0–5.0 |
| CaO | 18.0–45.0 |
| $Al_2O_3$ | 2.0–10.0 |
| $B_2O_3$ | 0.0–5.0 |
| $SiO_2$ | 10.0–40.0 |
| F | 12.0–35.0 |

| Oxide | wt % |
|---|---|
| $Na_2O$ | 0.2–14.4 |
| $K_2O$ | 0.0–2.5 |
| CaO | 31.0–41.9 |
| $Al_2O_3$ | 4.9–8.5 |
| $B_2O_3$ | 0.0–2.0 |
| $SiO_2$ | 15.6–30.7 |
| F | 14.4–30.8 |

EXAMPLE 1

The following glass compositions were made conventionally (dry-mixing of raw materials, fusing, and quenching in air). The oxide compositions of the glasses were analyzed using a 5100 PC Atomic Absorption Spectrophotometer (Perkin Elmer, Conn.). The fluorine content was determined by a laboratory method. The method consists of intimately mixing a sample with $Al_2O_3$ and $SiO_2$, passing 1010° C. super heated steam over the mixture collecting the distillate, and titrating the fluoride with Thorium Nitrate (Fisher Scientific, N.J.) at a pH of 3.0 using Alizarine Red "S" (MCB, N.J.) as indicator.

TABLE 1

| | 1 | 2 | 3 | 4 | 5 | 6 | 7 | 8 |
|---|---|---|---|---|---|---|---|---|
| $Na_2O$ | 0.2 | 11.2 | 14.2 | 14.4 | 10.3 | 11.2 | 10.6 | 10.5 |
| $K_2O$ | 2.5 | 0.0 | 0.0 | 0.0 | 0.4 | 0.3 | 0.3 | 0.2 |
| CaO | 35.7 | 41.4 | 33.6 | 31.0 | 36.3 | 41.2 | 38.0 | 41.9 |
| $Al_2O_3$ | 8.5 | 4.9 | 5.9 | 7.7 | 5.9 | 6.1 | 6.6 | 6.4 |
| $B_2O_3$ | 0.0 | 1.9 | 0.0 | 0.0 | 2.0 | 1.0 | 0.6 | 0.3 |
| $SiO_2$ | 30.0 | 20.9 | 15.6 | 16.8 | 30.7 | 24.3 | 25.8 | 21.1 |
| F | 23.2 | 19.6 | 30.8 | 30.1 | 14.4 | 15.9 | 18.1 | 19.6 |

EXAMPLE 2

Glass composition representative of the invention having the composition of Example 2 of Table 1 above was pulverized to a fineness of about 200 mesh.

A 30 grams sample was placed in a wide mouth crucible kept in a desiccator with water in the bottom. The weight change of the powder was monitored over a period of time and the results were compared to that obtained on a commercial frit. The inventive glass was determined to be superior to the commercial glass in terms of moisture absorption at room temperature. As the results in Table 3 show, the moisture absorption by the inventive high fluorine frit is considerably less than that of a commercial frit.

TABLE 3

| Time | Commercial Frit | High Fluorine Frit |
|---|---|---|
| 24 hours | 1.46 | 0.64 |
| 48 hours | 2.52 | 0.86 |
| 1 week | 6.57 | 1.57 |
| 2 weeks | 11.7 | 2.57 |
| 3 weeks | 16.2 | 4.16 |
| 4 weeks | 20.5 | 5.68 |

The amount of fluorine released from the inventive glass at 1010° C. was determined and compared to the corresponding release from a raw mix of identical theoretical composition. The method used was the same as described above.

TABLE 4

| Elapsed Time of Distillation | Fused Glass | Raw Mix |
|---|---|---|
| 5 minutes | 55.6 | 76.2 |
| 10 minutes | 61.7 | 84.2 |
| 15 minutes | 64.4 | 88.6 |
| 30 minutes | 69.8 | 96.0 |
| 45 minutes | 74.8 | 99.1 |

X-ray diffraction show that calcium fluoride crystal phase is present in the as quenched glass. Although the melting point of calcium fluoride is reported in literature as being 1360° C., the fluorspar which is present as a discrete phase in the glassy matrix very quickly melts almost instantaneously with the glass component.

A key advantage of the vitrified glass of the present invention over raw mixes is that the glass does not readily release the fluorine content at high temperatures and can therefore, alone or in a blended combination with other components be useful as a mold powder in the context of continuous casting process. It was surprisingly found that the presence of fluorine-providing compound as a discrete phase in the flux does not result in the generation of fluoride emissions or fumes above the caster in a volume and concentration to constitute a potential hazard.

A yet additional desirable characteristic of the inventive vitrified glass is that it is not hygroscopic and that it may therefore be used in an automated process for the continuous casting of a metal.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A glass composition which is lithium-free and which is suitable as a metallurgical mold powder, comprising, based on total weight of the glass composition:

| Oxide | wt % |
|---|---|
| $Na_2O$ | 0.2–14.4 |
| $K_2O$ | 0.0–2.5 |
| CaO | 31.0–41.9 |

-continued

| Oxide | wt % |
|---|---|
| $Al_2O_3$ | 4.9–8.5 |
| $B_2O_3$ | 0.00–1.9 |
| $SiO_2$ | 15.6–30.0 |
| F | 18.1–30.8 |

wherein the glass composition has a total content of $Na_2O+K_2O+CaO$ which ranges from about 38.4 to about 52.6% so that the glass composition is lithium-free and is suitable as a metallurgical mold powder.

2. The glass composition according to claim 1, wherein the glass composition has a form of particles having an maximum size of less than 80 mesh.

* * * * *